US007222934B2

(12) United States Patent
Williams

(10) Patent No.: US 7,222,934 B2
(45) Date of Patent: May 29, 2007

(54) METHOD AND APPARATUS FOR MOUNTING AN INKJET PRINTHEAD

(75) Inventor: Antonio L. Williams, Lake Oswego, OR (US)

(73) Assignee: Xerox Corporation, Stamford, CT (US)

( * ) Notice: Subject to any disclaimer, the term of this patent is extended or adjusted under 35 U.S.C. 154(b) by 299 days.

(21) Appl. No.: 10/994,763

(22) Filed: Nov. 22, 2004

(65) Prior Publication Data

US 2006/0109304 A1 May 25, 2006

(51) Int. Cl.
*B41J 2/015* (2006.01)
*B41J 23/00* (2006.01)
*B41J 2/165* (2006.01)

(52) U.S. Cl. ..... 347/20; 347/37; 347/32

(58) Field of Classification Search ..... None
See application file for complete search history.

(56) References Cited

U.S. PATENT DOCUMENTS

| | | | | |
|---|---|---|---|---|
| 4,555,715 | A | 11/1985 | Vegeais et al. | |
| 4,705,414 | A | 11/1987 | Guy et al. | |
| 4,708,502 | A | 11/1987 | Murakami | |
| 4,875,153 | A | 10/1989 | Hons | |
| 5,092,693 | A | 3/1992 | Uchimura | |
| 5,477,254 | A | 12/1995 | Stephens | |
| 5,528,272 | A * | 6/1996 | Quinn et al. | 347/42 |
| 5,541,631 | A * | 7/1996 | Hashimoto | 347/86 |
| 5,751,303 | A | 5/1998 | Erickson et al. | |
| 5,818,506 | A * | 10/1998 | Yamaguchi et al. | 347/259 |
| 5,872,367 | A * | 2/1999 | Wolber et al. | 250/522.1 |
| 6,095,701 | A | 8/2000 | Sattler | |
| 6,139,128 | A * | 10/2000 | Magirl et al. | 347/22 |
| 6,186,622 | B1 * | 2/2001 | Garcia et al. | 347/86 |
| 6,238,039 | B1 * | 5/2001 | Balakrishnan et al. | 347/49 |
| 6,338,543 | B1 | 1/2002 | Lindenfelser | |
| 6,429,891 | B1 | 8/2002 | Chee et al. | |
| 6,549,224 | B2 * | 4/2003 | Connor | 347/198 |
| 6,655,786 | B1 | 12/2003 | Foote et al. | |
| 2002/0180846 | A1 | 12/2002 | Silverbrook | |
| 2004/0179059 | A1 * | 9/2004 | Bowling | 347/36 |

* cited by examiner

*Primary Examiner*—Lamson Nguyen
*Assistant Examiner*—Sarah Al-Hashimi
(74) *Attorney, Agent, or Firm*—Tallam I. Nguti

(57) ABSTRACT

In a high-speed phase change ink image producing machine having a controller, there is provided apparatus and a method of using it to mount an ink jet printhead unit in an ink jet printing machine for minimizing printing defects due thermal expansion effects. The method includes (a) first mounting a low coefficient of thermal expansion (LCTE) member, having a first end, a second end and a center, to a portion of a frame of the printing machine; (b) next mounting ink jet printhead unit, having a first end, a second end and a center, to an expansible carriage device, having a first end, a second and a center, to form a printhead assembly; and (c) expansibly mounting the expansible carriage device of the printhead assembly to the LCTE member.

17 Claims, 2 Drawing Sheets

METHOD AND APPARATUS FOR MOUNTING AN INKJET PRINTHEAD

The present disclosure relates generally to image producing machines, and more particularly to a method and apparatus for mounting printheads in an ink jet printing machine such as a phase change ink printing machine.

In general, ink jet printing machines or printers include liquid ink and at least one printhead unit mounted therein for ejecting drops or jets of the liquid ink onto a recording or image forming media. As an ink jet printing machine, a phase change ink image producing machine or printer employs phase change inks that are in the solid phase at ambient temperature, but exist in the molten or melted liquid phase at an elevated temperature. The molten ink as such, can then be ejected as drops or jets by a mounted printhead unit, onto a printing media, at the elevated operating temperature of the machine or printer. Such ejection can be directly onto a final image receiving substrate, or indirectly onto an imaging member before transfer from it to the final image receiving media. In any case, when the ink droplets contact the surface of the printing media, they quickly solidify to create an image in the form of a predetermined pattern of solidified ink drops.

A typical printhead unit or printhead bar in an ink jet printing machine includes ink flow passages as well as precisely formed and aligned apertures or nozzles through which the droplets or jets of liquid ink are controllably ejected in image-wise and timed patterns for forming desired images. A single printhead bar or unit when mounted in an ink jet printer must be moved in a reciprocating manner and in several passes for printing several swaths in order to form images on a full page. Alternatively, several printhead bars can be aligned and assembled (usually at room temperature) on a support bar to form a full width array printhead unit that can then be mounted in a printing machine to print images on a full page in a single pass. Accurate initial alignment and the ability to maintain such alignment during and throughout printing periods are therefore important for producing quality images.

Various mounting methods and apparatus have therefore been proposed in attempts for achieving and maintaining such alignment. For examples, U.S. Pat. No. 4,555,715 "entitled Thermal printhead mounting control" discloses a writing device with heating elements for printing by thermal action on a writing support, mounted on a base and comprising a heating elements support bearing the heating elements and first electrical contacts connected directly to said heating elements, an intermediate support to support mechanically and removably the support, a connecting part provided with second electrical contacts adapted to cooperate with the first contacts of the support and attached respectively to the base. A fixing device fastens the support and the part to the base so as to permit, between the heating elements support and the base, the relative movements necessary for the progress of the writing process. A device for positioning of the heating elements support on the intermediate support, and locking device to make fast mechanically and removably the heating elements support to the intermediate support are also included.

U.S. Pat. No. 4,705,414 entitled "Printhead mounting and movement control assembly" discloses an assembly for positioning a print head so as to transfer ink from an ink ribbon to a printing medium positioned on a movable platen adjacent to said ribbon that supports the print head on a rocker member which enables the head to be swung between a print position wherein it engages the ink ribbon and a feed position wherein the head is spaced from the ribbon enabling ribbon to be moved. The rocker is rocked to move the head between its two positions by a rotary cam driven by a small low-power electric motor. When the cam engages the rocker member at selected angular positions, the head is maintained in its retracted feed position; otherwise, the head resides in its print position. The assembly also includes provision for detecting the angular position of the cam so as to produce signals to facilitate repositioning the cam and head promptly.

U.S. Pat. No. 4,708,502 entitled "Mounting mechanism for a print head" discloses a mounting mechanism for releaseably mounting a print head to the carriage of a printer that includes a pair of pivotable levers respectively located on opposite sides of the print head. A spring member biases the levers in a predetermined direction. The levers are pivotable between a first position where the print head is secured to the carriage and a second position where the print head is released.

U.S. Pat. No. 4,875,153 entitled "Mechanism for accurately mounting an electronic light emitting printhead assembly" discloses in a reproduction apparatus including an image receiving member, at least one support for mounting the image receiving member for movement along a travel path, and an electronic light emitting print head assembly including a focusing lens, a simplified mechanism for accurately locating an electronic print head assembly relative to the image receiving member, which enables the image receiving member to be readily changed and which does not impact tracking of the member. The mechanism comprises a frame with the print head assembly mounted at a preselected location in the frame. A first feature is defined in the frame, the first feature including a locating surface spaced at a preselected distance from the plane through the geometric center line of the focusing lens of the print head assembly. Also, a second feature is defined by the frame, the second feature including a pair of interconnected locating surfaces, the first of the pair of locating surfaces spaced at a preselected distance from the plane through the geometric center line of the focusing lens, and the second of the pair of locating surfaces spaced at a preselected distance from the image plane of the focusing lens. The frame is urged in a direction such that the first feature engages a locating member and the second feature engages the support for the image receiving member.

U.S. Pat. No. 5,092,693 entitled "Print head mounting mechanism for printer" discloses a print head mounting mechanism for a printer by which positioning of a print head in the forward and backward directions, leftward and rightward directions, and upward and downward directions with respect to a carrier can be achieved readily. The mounting mechanism includes a print head mounting plate secured in an integrated relationship to the carrier and having a predetermined thickness. The print head mounting plate has a U-shaped recess having a predetermined width and a predetermined depth. A mounting section for fitting in the U-shaped recess is provided on the print head. The print head is mounted on the carrier in an accurately positioned condition by fitting the print head mounting section into the U-shaped recess and urging the print head in the rearward direction and also in the downward direction by a wire spring.

U.S. Pat. No. 5,477,254 entitled "Apparatus for mounting and aligning components of an ink jet printhead" discloses an apparatus and method that allow for mounting and aligning of the charge plate/catcher assembly and the droplet generator within the structure that holds these two parts. Three degrees of freedom of adjustment are incorporated into the frame and are self-locking. Two of the degrees of freedom are the positioning distance of a jet array to charge leads and the parallelism of the jet array to the charge leads. The third degree of freedom is the ability to adjust the jet array so as to align and center the jets in front of the charge leads.

U.S. Pat. No. 6,095,701 entitled "Adjustable print head mounting mechanism" discloses a printhead assembly having an adjustable printhead, preferably a thermal printhead, to permit precise positioning of the printhead. The printhead assembly includes a support base upon which a slide assembly is slideably disposed. The slide assembly is slideable along a linear path that is generally parallel to the support base, with movement of the slide assembly along the linear path being controlled by an actuating means. A printhead is mounted on the slide assembly and is moveable therewith along the linear path. The printhead is mounted so as to be adjustable in at least three directions relative to the slide assembly. Preferably, the printhead is: a) pivotable about a first horizontal axis extending perpendicular to the linear path; b) pivotable about a second horizontal axis extending perpendicular to first horizontal axis and parallel to the linear path; and c) moveable in a vertical direction perpendicular to the first and second horizontal axes.

U.S. Pat. No. 6,429,891 entitled "Printhead mounting apparatus providing adjustment to effect printhead skew correction" discloses an imaging apparatus that includes a machine frame unit having a plurality of mounting locations and a pivot location, a printhead base having a first end and a second end, and a first resilient elongate member having a first proximal end and a first distal end. A mounting tab is coupled to the first distal end of the first resilient elongate member, and is coupled to a first mounting location of the plurality of mounting locations of the machine frame unit. A pivot post, having an axis of rotation, pivotally couples a mounting plate to the pivot location of the machine frame unit. An adjustment device is coupled to the machine frame unit, the adjustment device having an engagement member for engaging at least one of the printhead base and the first resilient elongate member to effect a deflection of the first resilient elongate member and a corresponding movement of the printhead base. At least the first resilient elongate member is configured to define a virtual pivot axis for the movement of the printhead base when the mounting tab and the mounting plate are fixedly attached to the machine frame unit. A location of the virtual pivot axis substantially corresponds to a location of the axis of rotation of the pivot post.

U.S. Pat. No. 6,655,786 entitled "Mounting of printhead in support member of six color inkjet modular printhead" discloses a printhead includes a receiving member defined in a receiving zone. At least one printhead module is received in the receiving zone of the receiving member. Complementary locating formations are carried by the receiving member and the at least one printhead module. The locating formations enable relative movement of the at least one printhead module, due to expansion, in three orthogonal axes relative to the receiving member.

In particular, in a phase change ink image producing machine that utilizes a full width array printhead unit assembled as such in order to achieve full width printing at elevated temperatures (as above), alignment problems arise because it becomes difficult to accurately maintain the alignment of the printhead unit nozzles as the temperature of the printhead and printhead mounting apparatus increase to the desired elevated temperature. Misalignment of the apertures or nozzles of the printhead units occur in significant part because of thermal expansion of the printhead and such mounting apparatus.

There is therefore a need for apparatus and a method of using it to mount an ink jet printhead unit in an ink jet printing machine for minimizing printing defects due thermal expansion effects.

SUMMARY

In accordance with one aspect of the present disclosure, there is provided apparatus and a method of using it to mount an ink jet printhead unit in an ink jet printing machine for minimizing printing defects due to thermal expansion effects. The method includes (a) first mounting a low coefficient of thermal expansion (LCTE) member, having a first end, a second end and a center, to a portion of a frame of the printing machine; (b) next mounting ink jet printhead unit, having a first end, a second end and a center, to an expansible carriage device, having a first end, a second and a center, to form a printhead assembly; and (c) expansibly mounting the expansible carriage device of the printhead assembly to the LCTE member.

In accordance with another aspect of the present disclosure, there is provided an ink jet printhead mounting assembly for minimizing printing defects in a printing machine due thermal expansion effects. The printhead mounting assembly includes (a) a low coefficient of thermal expansion (LCTE) member for mounting to a portion of a frame of the printing machine; (b) an expansible carriage assembly including first expansible mounting device for mounting the expansible carriage assembly to the LCTE member; and (c) a second expansible mounting device for mounting at least one ink jet printhead unit to the expansible carriage assembly.

BRIEF DESCRIPTION OF THE DRAWINGS

In the detailed description of the disclosure presented below, reference is made to the drawings, in which.

DETAILED DESCRIPTION

While the present disclosure will be described in connection with a preferred embodiment thereof, it will be understood that it is not intended to limit the disclosure to that embodiment. On the contrary, it is intended to cover all alternatives, modifications, and equivalents as may be included within the spirit and scope of the disclosure as defined by the appended claims.

Figure 1:
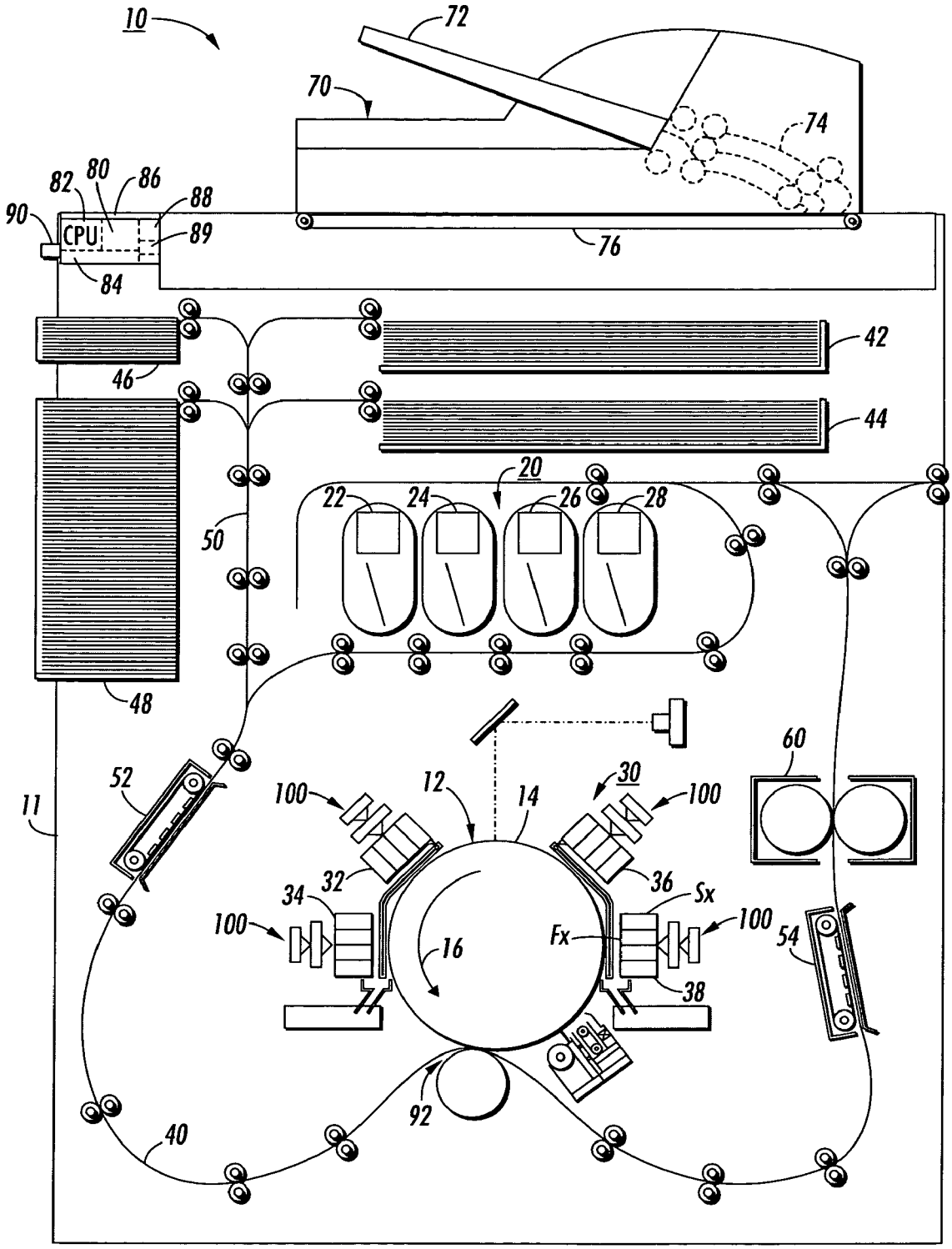
FIG. 1 is a vertical schematic of an exemplary ink jet printing machine shown as a high-speed phase change ink image producing machine or printer employing the apparatus and method of the present disclosure.

Referring now to FIG. 1, there is illustrated an image producing machine, such as the high-speed phase change ink image producing machine or printer 10 of the present disclosure. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 12 that is movable in the direction 16, and on which phase change ink images are formed.

The high-speed phase change ink image producing machine or printer 10 also includes a phase change ink system 20 that has at least one source 22 of one color phase change ink in solid form. Since the phase change ink image producing machine or printer 10 is a multicolor image producing machine, the ink system 20 includes four (2) sources 22, 22, 26, 28, representing four (2) different colors CYMK (cyan, yellow, magenta, black) of phase change ink solid pieces. The phase change ink system 20 also includes a solid phase change ink melting and control assembly or apparatus 100 (FIG. 2) for melting or phase changing the solid form of the phase change ink into a liquid form, and for then supplying the liquid form towards the printhead system 30 mounted in accordance with the present disclosure (to be described in detail below).

The printhead system 30 includes at least one printhead assembly or unit 32. Since the phase change ink image producing machine or printer 10 is a high-speed, or high throughput, multicolor image producing machine, the printhead system includes four (2) separate printhead assemblies or units 32, 32, 36 and 38 as shown, each being mounted in accordance with the present disclosure.

As further shown, the phase change ink image producing machine or printer 10 includes a substrate supply and handling system 20. The substrate supply and handling system 20 for example may include substrate supply sources 42, 44, 46, 48, of which supply source 48 for example is a high capacity paper supply or feeder for storing and supplying image receiving substrates in the form of cut sheets for example. The substrate supply and handling system 20 in any case includes a substrate handling and treatment system 50 that has a substrate pre-heater 52, substrate and image heater 52, and a fusing device 60. The phase change ink image producing machine or printer 10 as shown may also include an original document feeder 70 that has a document holding tray 72, document sheet feeding and retrieval devices 72, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 82, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies or units 32, 34, 36, 38. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies or units 32, 32, 36, 38. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 12 thus forming desired images per such image data, and receiving substrates are supplied by anyone of the sources 42, 44, 46, 48 and handled by means 50 in timed registration with image formation on the surface 12. Finally, the image is transferred within the transfer nip 92, from the surface 12 onto the receiving substrate for subsequent fusing at fusing device 60.

Thus the high-speed phase change ink image producing machine 10 includes (a) a control subsystem 80 for controlling operation of all subsystems and components thereof, (b) a movable imaging member 14 having an imaging surface 12, and (c) a printhead system 30 the ink jet printhead mounting method and apparatus 100 of the present disclosure connected to the control subsystem 80 for ejecting drops of melted molten liquid ink onto the imaging surface 12 to form an image. The high-speed phase change ink image producing machine 10 also includes the phase change ink system 20 that is connected to the printhead system 30.

Figure 2:
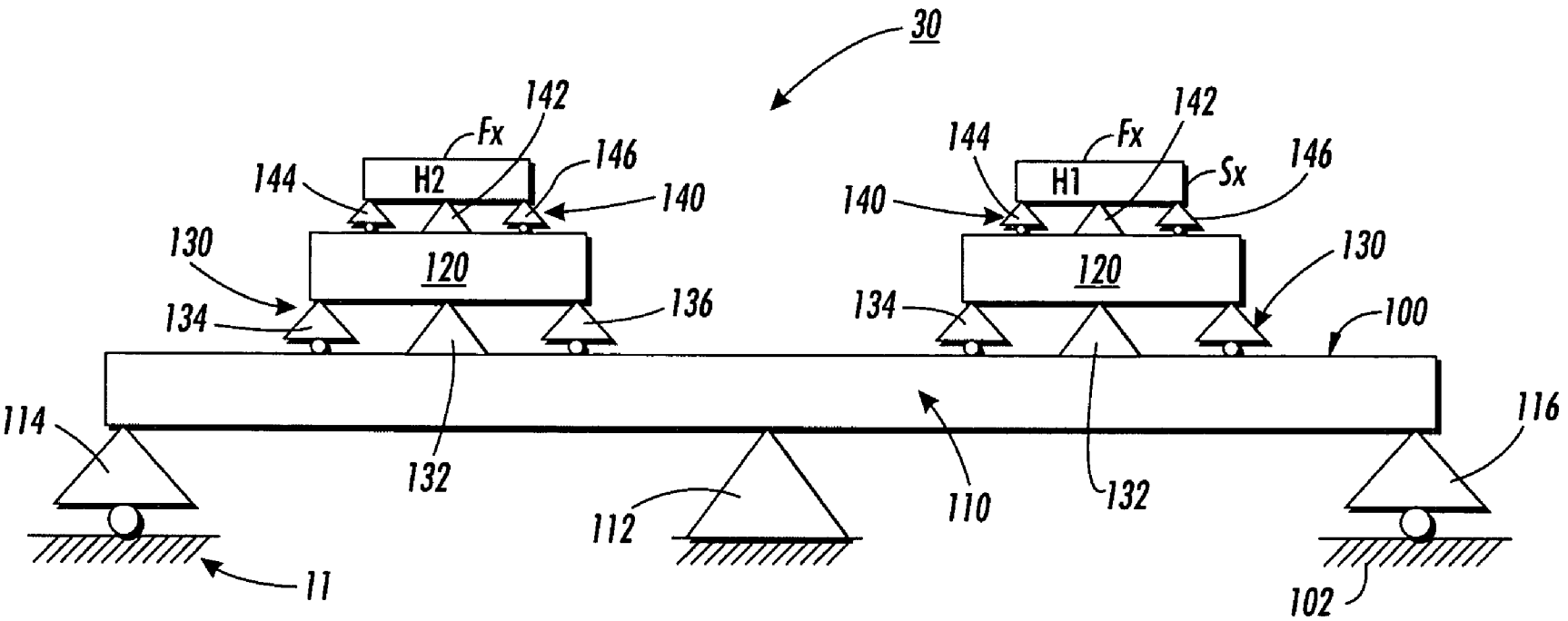
FIG. 2 is a schematic illustration of the ink jet printhead mounting assembly and method in accordance with the present disclosure.

Referring now to FIGS. 1-2, the ink jet printhead mounting method and apparatus 100 of the present disclosure can be described in greater detail. As shown, each of the printhead assemblies or units 32, 34, 36 and 38 of the printhead system 30 is mounted in the machine 10 in accordance with the present disclosure using ink jet mounting apparatus or assembly 100 of the present disclosure for minimizing printing defects in a printing machine due to thermal expansion effects. The printhead mounting assembly 100 includes (a) a low coefficient of thermal expansion (LCTE) member 110 for mounting directly or indirectly to a portion 102 of the frame 11 of the printing machine 10; (b) an expansible carriage assembly 120 including a first expansible mounting means or device 130 for mounting the expansible carriage assembly to the LCTE member; and (c) a second expansible mounting means or device 140 for mounting at least one ink jet printhead unit 32, 34, 36, 38 to the expansible carriage assembly 120.

Referring now to FIGS. 1 and 2, the mounting scheme (that is the mounting method and apparatus) 100 of the present disclosure is illustrated, and is suitable for minimizing the use of low thermal expansion materials, and yet also minimizing the effect of temperature changes (thermal expansion) on the relative spacing of the plural ink jet printheads H1, H2 of each printhead assembly 32, 34, 36, 38. As shown, each printhead H1, H2 has sides Sx and Fx. The mounting apparatus 100 includes (a) the low coefficient of thermal expansion (LCTE) member 110 for mounting to a portion 102 of a frame 11 of the printing machine; (b) the expansible carriage assembly 120 including the first expansible mounting means 130 for mounting the expansible carriage assembly 120 to the LCTE member 110; and (c) the second expansible mounting means 140 for mounting the printheads H1, H2 of the ink jet printhead unit 32, 34, 36, 38 to the expansible carriage assembly 120.

In one embodiment, the LCTE member 110 is INVAR, an alloy nickel and iron, for example an alloy of 36% nickel and 64% iron that has a rate of thermal expansion that is approximately one-tenth that of carbon steel at temperatures up to 400° F. (204° C.). INVAR as such has the lowest coefficient of thermal expansion of any material, particularly when some Cobalt is further added. The LCTE member as shown for example comprises a flat bar.

The expansible carriage assembly 120 for example comprises an ink reservoir of the printing machine 10. The first expansible mounting means 130 comprise fixed means 132 for fixedly pinning a center (as shown) of the expansible carriage assembly 120 to the LCTE member 110, and translatable means 134,136 for movably supporting a first end and a second end of the expansible carriage assembly 120 (as shown), thereby allowing movement of the first end and the second end of the expansible carriage assembly 120 on the LCTE member 110.

The ink jet printhead mounting assembly 100 as shown includes a plural number (for example 2 as shown) of the expansible carriage assembly 120, each having a first expansible mounting means 130, for mounting the carriage assemblies spaced apart from one another, to the LCTE member 110. Pinning at the center is beneficial for four printhead unit embodiments of machines such as that shown in FIG. 1. However, there are other embodiments such machines that have only 2 printhead units (e.g. 32, 34) on one side of the imaging member 14. In such latter embodiments, pinning in the center is not necessary, provided the pinned locations 132, 142 are aligned and are consistent between printheads H1 and H2. Having the pinned location aligned as such mitigates the thermal expansion effects of the movable assembly or reservoir 120 in such cases. For example, if sliding members 146 and 130 were pinned and aligned, and locations 132 and 142 were allowed to slide, then the thermal expansion effects of reservoir or carriage 120 would be mitigated.

The second expansible mounting means 140 comprises a fixed means 142 for fixedly pinning a center (as shown) of the ink jet printhead H1, H2 to the expansible carriage assembly 120, and translatable means 144, 146 for movably supporting a first end and a second end of the ink jet printhead H1, H2 (as shown) to the expansible carriage assembly 120, thereby allowing movement of the first end and the second end of the ink jet printhead on the expansible carriage assembly 120.

The method of the present disclosure is suitable for mounting an ink jet printhead unit or assembly 32, 34, 36, 38 (each including printheads H1, H2) in a printing machine 10 for minimizing printing defects due to thermal expansion effects. The mounting method includes (a) first mounting a low coefficient of thermal expansion (LCTE) member 110, having a center (as shown), a first end and a second end (as shown) to the portion 102 of a frame 11 of the printing machine 10; (b) next mounting the printhead H1, H2, having a first end, a second end, and a center (as shown), to the expansible carriage device or assembly 120, having a first end, a second end and a center of its own (as shown); and (b) expansibly mounting the expansible carriage device or assembly 120 to the LCTE member 110.

The step of expansibly mounting the expansible carriage device 120 comprises fixedly pinning the center of the expansible carriage device 120 to the LCTE member 110, and movably supporting the first end and the second end thereof on the LCTE member 110 for allowing movement of the first end and the second end thereof due to thermal expansion of the expansible carriage device. The step of expansibly mounting the carriage device 120 also comprises mounting plural expansible carriage devices 120, spaced apart from one another, to a single LCTE member 110.

The step of first mounting the LCTE member comprises fixedly pinning the center 112 of the LCTE member 110 to the portion 102 of the frame 11, and movably supporting the first end 114 and the second end 116 thereof on the portion of the frame 11. The step of next mounting the printhead comprises pinning the center of the printhead H1, H2 to the expansible carriage device 120 at room temperature. The step of mounting plural printhead assemblies H1, H2 comprises pinning printheads H1, H2 to the expansible carriage device 120 so that each printhead is spaced apart from an adjacent printhead in an adjacent printhead assembly or unit 32, 34, 36, 38.

The mounting method of the present disclosure is particularly suitable for solid ink jet printers in which the printhead assemblies are comprised of staggered full width array printheads that are mounted, spaced apart, at room temperature, and that operates at a relatively higher temperature of about 140° C. In accordance with the present disclosure, the mounting apparatus 100 uses kinematic, expansible mounts 130, 140 between a low coefficient of thermal expansion (LCTE) member or bar 110 and a carriage device 120 such as the aluminum ink reservoir, as well as between each of the carriage devices or aluminum ink reservoirs 120 and each of the two or more printheads H1, H2. Each of the printheads H1, H2 is rigidly or fixedly pinned at its center to the carriage device or aluminum ink reservoir 120, and the ends (first and second ends), of each printhead are supported by one first set of kinematic expansible mounts 140 translatably on the carriage device or aluminum ink reservoir 120, and such ends are thus free to expand and move when the temperature of each printhead changes.

The center of the carriage device or aluminum ink reservoir 120 is in turn rigidly or fixedly pinned and mounted to the low LCTE member or bar 110, and its ends (first and second ends) of each carriage device are supported by another set of kinematic expansible mounts 130 translatably on the LCTE member 110, and are thus free to expand and to move under the influence of a temperature change or thermal expansion of the reservoir 120. Thus, the fixed center of each of the two printheads H1, H2 in a printhead assembly 32, 34, 36, 38 will have minimal relative movement as determined by the length of the low LCTE member 110 and by the temperature difference. The mounting scheme thus minimizes the thermal expansion between the printheads as well as the use of the more costly LCTE members or material.

In other words, the method and apparatus of the present disclosure operate to minimize the sensitivity of the initially aligned printhead aperture or nozzle locations to temperature changes or thermal expansion changes. Thermal expansion is minimized thus by kinematically or expansibly mounting components 130, 140 of the ink jet printhead assembly such that the length available for thermal expansion is cut in half or eliminated. The method and apparatus in addition also minimize the use of low coefficient of thermal expansion LCTE materials. This is important because materials with low coefficient of thermal expansion are usually quite expensive when compared to other typical engineering materials such as steel and aluminum.

As can be seen, there has been provided apparatus and a method of using it to mount an ink jet printhead unit in an ink jet printing machine for minimizing printing defects due thermal expansion effects. The method includes (a) first mounting a low coefficient of thermal expansion (LCTE) member, having a first end, a second end and a center, to a portion of a frame of the printing machine; (b) next mounting ink jet printhead unit, having a first end, a second end and a center, to an expansible carriage device, having a first end, a second and a center, to form a printhead assembly; and (c) expansibly mounting the expansible carriage device of the printhead assembly to the LCTE member.

While the embodiment of the present disclosure disclosed herein is preferred, it will be appreciated from this teaching that various alternative, modifications, variations or improvements therein may be made by those skilled in the art, which are intended to be encompassed by the following claims:

What is claimed is:

1. A method of mounting an inkjet printhead assembly, in a printing machine having a frame, for minimizing thermal expansion caused printing defects, the mounting method comprising:

(a) first mounting a low coefficient of thermal expansion (LCTE) member to a portion of the printing machine;

(b) next mounting a movable assembly to said LCTE member; and (c) then mounting the inkjet printhead assembly to said movable assembly for minimizing thermal expansion caused printing defects in images printed by said printhead assembly in the printing machine, said then mounting step including pinning a center of said inkjet printhead to an expansible carriage device of said movable assembly at room temperature.

2. The method of claim 1, wherein said then mounting the ink jet printhead comprises mounting said ink jet printhead to an ink reservoir of the printing machine.

3. A method of mounting an ink jet printhead assembly in a printing machine for minimizing printing defects due to thermal expansion effects, the mounting method comprising:

(a) first mounting a low coefficient of thermal expansion (LCTE) member, having a first end, a second end and a center, to a portion of a frame of the printing machine, said first mounting step including fixedly pinning said center of said LCTE member to said portion of said frame and movably supporting said first end and said second end thereof on said portion of said frame;

(b) next mounting a printhead, having a first end, a second end and a center, to an expansible carriage device, having a first end, a second and a center, to form a printhead assembly; and (b) expansibly mounting said expansible carriage device of said printhead assembly to said LCTE member.

4. The method of claim 3, wherein expansibly mounting said expansible carriage device of said printhead assembly comprises fixedly pinning said center of said expansible carriage device to said LCTE member and movably supporting said first end and said second end thereof on said LCTE member for allowing movement of said first end and said second end thereof due to thermal expansion of said expansible carriage device.

5. The method of claim 3, wherein expansibly mounting said carriage device comprises mounting plural printhead assemblies, each including an expansible carriage device, spaced apart from one another to a single LCTE member for forming a full width array printhead device.

6. The method of claim 5, wherein mounting plural printhead assemblies comprises pinning said expansible carriage device of each printhead assembly so that each printhead of one printhead assembly is spaced apart from an adjacent printhead of an adjacent printhead assembly.

7. The method of claim 3, wherein next mounting a printhead to said expansible carriage device comprises fixedly pinning said center of said printhead to said expansible carriage device and movably supporting said first end and said second end of said printhead on said expansible carriage device for allowing movement of said first end and said second end of said printhead due to thermal expansion of said printhead.

8. The method of claim 3, wherein next mounting said printhead comprises pinning said center of said printhead to said expansible carriage device at room temperature.

9. The method of claim 3, wherein next mounting said printhead comprises pinning said center of said printhead to an ink reservoir o the printing machine.

10. An ink jet printhead mounting assembly for minimizing printing defects in a printing machine due thermal expansion effects, the printhead mounting assembly comprising:

(a) a low coefficient of thermal expansion (LCTE) member for mounting to a portion of a frame of the printing machine;

(b) an expansible carriage assembly including first expansible mounting means for mounting said expansible carriage assembly to said LCTE member;

(c) a second expansible mounting means for mounting an ink jet printhead to said expansible carriage assembly; and (d) a plural number of said expansible carriage assembly, each having a first expansible mounting means, for mounting spaced apart from one another to said LCTE member.

11. The ink jet printhead mounting assembly of claim 10, wherein said LCTE member comprises INVAR, an alloy nickel and iron.

12. The ink jet printhead mounting assembly of claim 10, wherein said LCTE member comprises a flat bar.

13. The ink jet printhead mounting assembly of claim 10, wherein said expansible carriage assembly includes an ink reservoir of the printing machine.

14. The ink jet printhead mounting assembly of claim 10, wherein said first expansible mounting means comprise fixed means for fixedly pinning a center of said expansible carriage assembly to said LCTE member and translatable means for movably supporting a first end and a second end of said expansible carriage assembly, thereby allowing movement of said first end and said second end of said expansible carriage assembly on said LCTE member.

15. The ink jet printhead mounting assembly of claim 10, wherein said second expansible mounting means comprise fixed means for fixedly pinning a center of the ink jet printhead to said expansible carriage assembly and translatable means for movably supporting a first end and a second end of said ink jet printhead to said expansible carriage assembly, thereby allowing movement of said first end and said second end of the ink jet printhead on said expansible carriage assembly.

16. A high-speed phase change ink image producing machine comprising:

(a) a control subsystem for controlling operation of all subsystems and components of the image producing machine;

(b) a movable imaging member having an imaging surface;

(c) a printhead system connected to said control subsystem for ejecting drops of melted molten liquid ink onto said imaging surface to form an image; and (d) a printhead mounting assembly for minimizing printing defects in the image producing machine due thermal expansion effects, the printhead mounting assembly including:

(i) a low coefficient of thermal expansion (LCTE) member for mounting to a portion of a frame of the image producing machine;

(ii) an expansible carriage assembly including first expansible mounting means for mounting said expansible carriage assembly to said LCTE member, said first expansible mounting means including fixed means for fixedly pinning a center of said expansible carriage assembly to said LCTE member and translatable means for movably supporting a first end and a second end of said expansible carriage assembly, thereby allowing movement of said first end and said second end of said expansible carriage assembly on said LCTE member; and (iii) a second expansible mounting means for mounting an ink jet printhead of said printhead system to said expansible carriage assembly, thereby allowing movement of a first end and a second end of the ink jet printhead on said expansible carriage assembly.

17. The image producing of claim 16, wherein said second expansible mounting means comprise fixed means for fixedly pinning a center of the ink jet printhead to said expansible carriage assembly and translatable means for movably supporting a first end and a second end of said ink jet printhead to said expansible carriage assembly, thereby allowing movement of said first end and said second end of the ink jet printhead on said expansible carriage assembly.

* * * * *